US011096496B2

(12) United States Patent
Murray

(10) Patent No.: US 11,096,496 B2
(45) Date of Patent: Aug. 24, 2021

(54) THERAPEUTIC CHAIR WITH ADJUSTABLE BACK AND METHOD OF USING THE SAME

(71) Applicant: Hugh Charles Murray, Charleston, WV (US)

(72) Inventor: Hugh Charles Murray, Charleston, WV (US)

( * ) Notice: Subject to any disclaimer, the term of this patent is extended or adjusted under 35 U.S.C. 154(b) by 0 days.

(21) Appl. No.: 16/946,176

(22) Filed: Jun. 9, 2020

(65) Prior Publication Data

US 2020/0323349 A1 Oct. 15, 2020

Related U.S. Application Data

(60) Provisional application No. 62/832,473, filed on Apr. 11, 2019.

(51) Int. Cl.

| | |
|---|---|
| ***A47C 7/40*** | (2006.01) |
| ***A47C 7/46*** | (2006.01) |
| ***A47C 31/00*** | (2006.01) |

(52) U.S. Cl.

CPC ..... *A47C 7/402* (2013.01); *A47C 7/46* (2013.01); *A47C 31/008* (2013.01)

(58) Field of Classification Search

CPC ..... A47C 7/402; A47C 7/46; A47C 31/008
USPC ..... 297/353
See application file for complete search history.

(56) References Cited

U.S. PATENT DOCUMENTS

| | | | | |
|---|---|---|---|---|
| 4,981,325 | A | 1/1991 | Zacharkow | |
| 5,320,412 | A * | 6/1994 | Eakins | A61G 5/1067 297/353 |
| 5,328,245 | A | 7/1994 | Marks et al. | |
| 5,344,211 | A | 9/1994 | Adat et al. | |
| 5,678,893 | A | 10/1997 | Bock | |
| 5,871,258 | A | 2/1999 | Battey et al. | |
| 6,155,643 | A | 12/2000 | Gorgi et al. | |
| 6,637,820 | B2 | 10/2003 | Rogers, III et al. | |
| 6,692,081 | B2 | 2/2004 | Vik | |
| 7,249,802 | B2 | 7/2007 | Schmitz et al. | |
| 7,347,496 | B1 | 3/2008 | Wang | |
| 8,596,717 | B2 | 12/2013 | Glyck | |
| 9,033,416 | B1 | 5/2015 | Vanderhorst et al. | |
| 9,596,941 | B1 | 3/2017 | Romero | |
| 9,867,467 | B2 * | 1/2018 | Thorwesten | A47C 7/402 |
| 2002/0033626 | A1 | 3/2002 | Yoo | |
| 2005/0088024 | A1 * | 4/2005 | Rozaieski | 297/362.12 |
| 2008/0284230 | A1 | 11/2008 | Kinoshita et al. | |
| 2009/0051199 | A1 | 2/2009 | Crosbie | |
| 2012/0146376 | A1 | 6/2012 | Kang et al. | |
| 2015/0272333 | A1 | 10/2015 | Zouzal et al. | |
| 2017/0311725 | A1 | 11/2017 | Grove | |
| 2020/0154888 | A1 * | 5/2020 | Brown | A47C 7/402 |

* cited by examiner

*Primary Examiner* — Anthony D Barfield
(74) *Attorney, Agent, or Firm* — Dunlap Bennett & Ludwig, PLLC; Brendan E. Squire

(57) ABSTRACT

A therapeutic chair with an adjustable backrest and cushioned fulcrum pad allows users to extend their thoracic spine over the fulcrum of the adjustable chair back. The device allows the individual to sit on the chair and adjust the height of the backrest so the fulcrum is matched to the patient's need for movement.

9 Claims, 3 Drawing Sheets

THERAPEUTIC CHAIR WITH ADJUSTABLE BACK AND METHOD OF USING THE SAME

CROSS-REFERENCE TO RELATED APPLICATION

This application claims the benefit of priority of U.S. provisional application No. 62/832,473 filed Apr. 11, 2019, the contents of which are herein incorporated by reference.

BACKGROUND OF THE INVENTION

The present invention relates to therapeutic chairs, and more particularly to therapeutic chairs for those afflicted with Dowager's Hump.

Many people suffer from a Dowager's Hump or very limited thoracic spinal movement. A physical deformity resulting in a condition of over-curvature of the thoracic spine (upper back) of the body into a flexed or stooped posture. It commonly occurs in the spinal column of the chest. It is usually more prevalent in older females (especially post-menopausal) than in males. This abnormality can lead to a spinal curvature that is more than 40-45 degrees off of the normal axis. The poor posture associated with the condition leads to breathing difficulties, poor mobility, compression fractures and pain.

There are presently no other therapeutic chairs for this condition. There is a "work around" of sitting in the floor and bending backwards into the seat of chair, however, the afflicted individual must be able to sit on the floor and rise from sitting on the floor. Depending on the mobility of the individual, this may no longer be possible without assistance.

As can be seen, there is a need for an improved therapeutic chair that allows the individual to sit on a chair and adjust the height of the back of the chair so the fulcrum is matched to the patient's need for movement/thoracic extension.

SUMMARY OF THE INVENTION

In one aspect of the present invention, a therapeutic chair, is disclosed. The therapeutic chair includes a frame supporting a seat. The frame has a front end and a back end, a left side and a right side, a guide extending inwardly from back end of the frame. A vertically adjustable backrest has a rail mounted to a left side and a right side of the backrest. The rail is carried on the guide. A linear actuator has a first end and a second end, where the first end is coupled to the frame and the second end is coupled to the backrest. The linear actuator is operable to raise and lower the backrest relative to the seat along a plane defined by an alignment of the rail and the guide.

In some embodiments, a remote control is operatively coupled to the linear actuator. The remote control has one or more controls to selectively extend or retract the linear actuator.

In other embodiments, the therapeutic chair has a fulcrum pad attached to a top of the backrest. The fulcrum pad protrudes into an occupant space of the chair. When the backrest is in a lowered position, the fulcrum pad is positioned at a lumbar region of the occupant space. When the backrest is in an elevated position, the fulcrum pat is positioned at a shoulder region of the occupant space.

In yet other embodiments, a measuring device is attached to the chair and is configured to show an elevation of the backrest relative to the frame.

In other aspects of the invention, a therapeutic chair is disclosed. The therapeutic chair has a frame supporting a seat. The frame has a front end and a back end, a left side and a right side. The therapeutic chair also includes a backrest. A sliding guide and rail coupling is interposed between the backrest and a the frame to adjustably carry the backrest between a lowered position and an elevated position.

In some embodiments, the therapeutic chair may include a linear actuator having a first end and a second end. The first end is coupled to the frame and the second end is coupled to the backrest. The linear actuator is operable to raise and lower the backrest relative to the seat along a plane defined by an alignment of the sliding guide and rail coupling.

In other embodiments the therapeutic chair includes a fulcrum pad attached to a top of the backrest that protrudes into an occupant space of the chair. When the backrest is in a lowered position, the fulcrum pad is positioned at a lumbar region of the occupant space. When the backrest is in an elevated position, the fulcrum pat is positioned at a shoulder region of the occupant space.

In yet other embodiments, a measuring device is attached to the chair and is configured to show an elevation of the backrest relative to the frame.

These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides an apparatus and method for alleviating the deleterious effects of Dowager's Hump. The therapeutic chair allows the individual to sit on a chair and adjust the height of the back of the chair so the fulcrum is matched to the patient's need for movement. It is easier to perform this thoracic movement while sitting in a chair versus sitting in the floor.

As stated above, many people suffer from a Dowagers Hump or very limited thoracic spinal movement. The poor posture leads to breathing difficulties, poor mobility, compression fractures and pain. This adjustable chair improves mobility and eliminates the deformity. The invention claimed here solves this problem.

Figure 1:
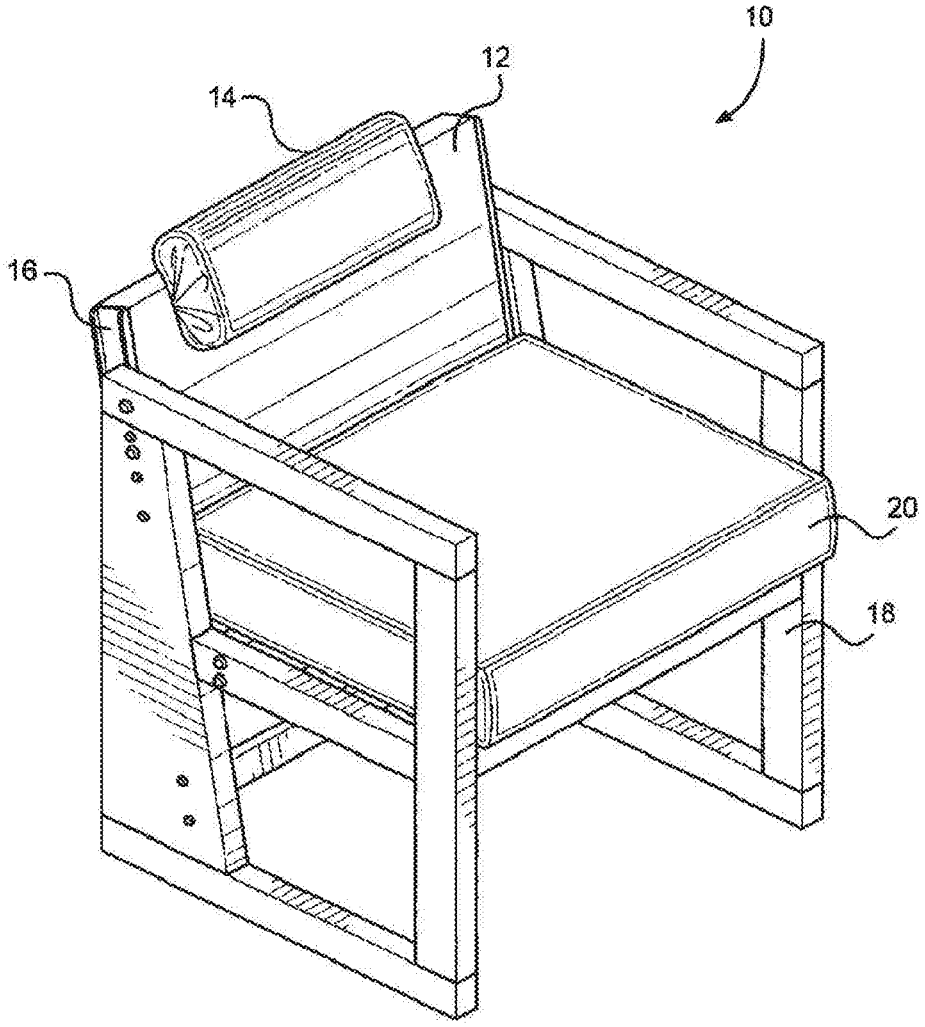
FIG. 1 is a front perspective view of the therapeutic chair.
Figure 2:
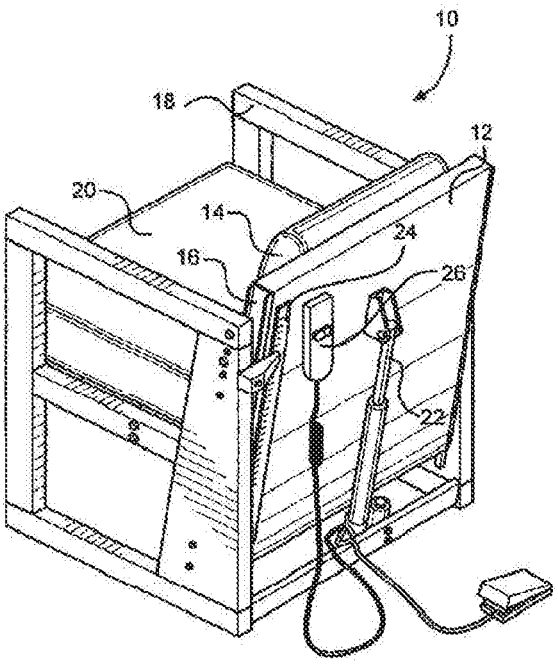
FIG. 2 is a back perspective view of the therapeutic chair in a retracted position.
Figure 3:
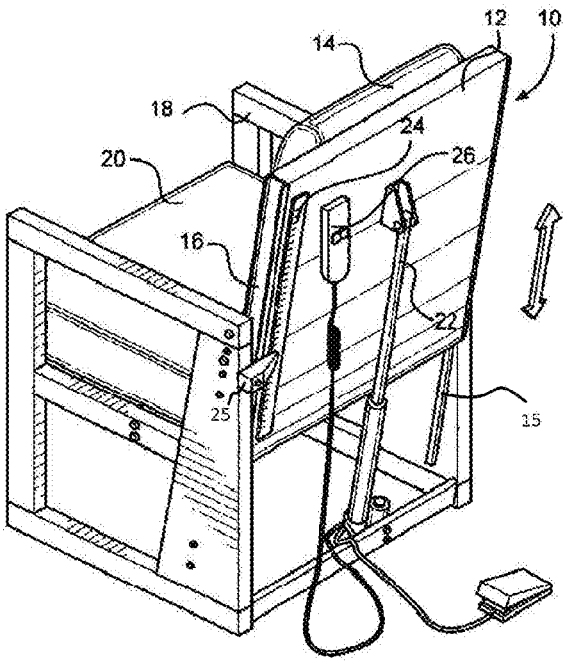
FIG. 3 is a back perspective view of the therapeutic chair in an extended position.
Figure 4:
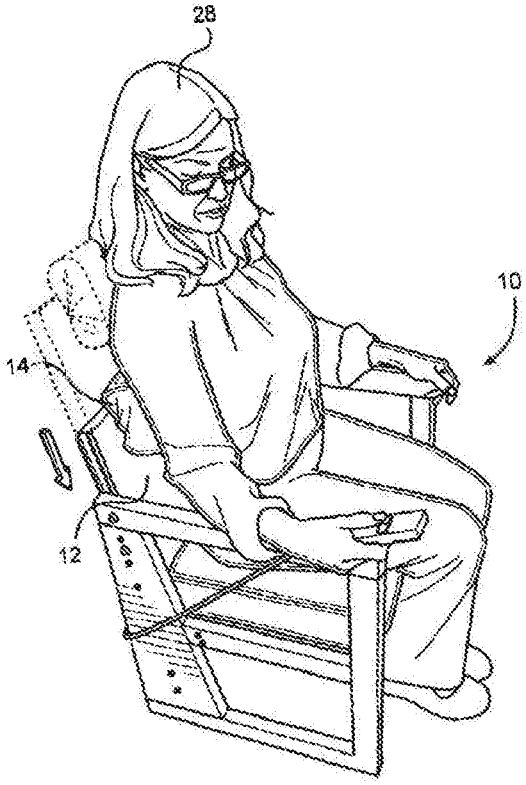
FIG. 4 is a first in-use view of the therapeutic chair.
Figure 5:
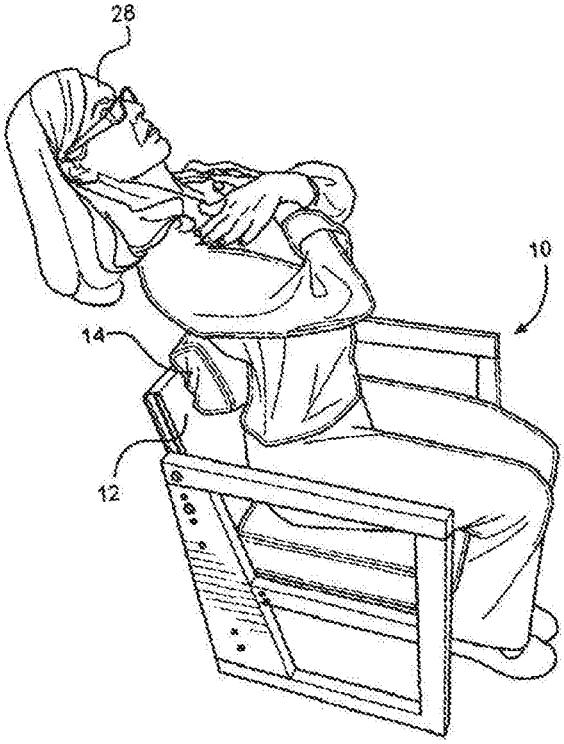
FIG. 5 is a second in-use view of the therapeutic chair.

As seen in reference to the drawings of FIGS. 1-5, the therapeutic chair of the present invention is a device that allows the individual to sit on a chair and adjust the height of the back of the chair so the fulcrum is matched to the patient's need for movement. Embodiments of the present invention may include the following elements:

The invention includes a chair 10 that may be made of metal or wood. The adjustable backrest 12 of the chair 10 is adjustable by moving up or down on a guide 15 and a rail 16 coupling interposed between the backrest 12 and the frame. The adjustable backrest 12 has a cushioned fulcrum pad 14 attached at an upper margin thereof that protrudes into an occupant space of the chair 10. The adjustable backrest 12 may be moved along the rail 16 by a linear actuator 22. The linear actuator 22 may be controlled by a wired or wireless remote 26 control. A measuring device 24 may be attached to the adjustable backrest 12 to indicate an elevation of the adjustable backrest 12.

In use, the backrest 12 is elevated or lowered to place the cushioned fulcrum pad 14 at the top the adjustable backrest 12 in the correct location to maximize movement of the thoracic spine during an aft extension against the fulcrum pad 14. Once the adjustable backrest 12 is positioned correctly the location can be recorded from the measuring device 24 for future reference. The person then extends their back over the top/fulcrum pad 14 of the adjustable backrest 12. This maximizes thoracic spinal extension which can reduce the effects of the Dowagers Hump.

The present invention can be made by modification of a standard wooden or metal chair. The backrest 12 of the chair may be removed, leaving the structural integrity of the chair frame 18 and placing the backrest 12 in an adjustable rail 16 on opposed sides of the backrest 12 or chair frame 18. The linear actuator 22 is then attached which provides a motive force to move the backrest 12 of the chair 10 up and down to a desired height.

The linear actuator 22 may be attached to the base of the chair 10 and to the adjustable backrest 12. Allowing the adjustable backrest 12 to move up and down through the rails 16 on either side of the chair 10. The linear actuator 22 is attached to either a wired or wireless remote control 26 allowing the user 28 to activate the linear actuator 22 and move the back of the chair through its expected motion. A measuring device 24 and indicator 25 is added to the adjustable backrest 12 for reference as to movement and for documentation.

This adjustable backrest 12 may be movable by one of an electric, pneumatic, or hydraulic actuator that is adjustable with the remote control 26. A person sitting in the chair 10 can actually raise or lower the adjustable backrest 12, maximizing the position of the top fulcrum pad 14 of the adjustable backrest 12 to allow the individual to produce the best fulcrum force on the individual's thoracic spine.

The adjustable backrest 12 on the chair 10 does not have to be powered electrically, as it can be powered manually, such as with adjustable set screws on either side. However, this may be more difficult and is more time consuming for the individual using the chair 10. Likewise, the chair 10 does not have to have a measuring device 24, but it enhances ease-of-use when returning to exercise the back again, particularly where the chair 10 may be utilized in a communal setting where it may be utilized by multiple individuals.

The present invention may be utilized to ameliorate poor sitting or standing posture which over time develops into significant limitation of movement in the mid and upper back, preventing correct posture, deep breathing and leads to compression fractures in individuals with osteopenia and osteoporosis. An individual would use this device to increase their thoracic range of motion into extension, thus improving their range of motion and their posture to help unload the thoracic spine, the abdominal contents, and the heart and lungs. This reduces the chances of compression fractures in the thoracic spine. An individual would use this device repeatedly through the day, such as, for sessions of 10 repetitions each bending backwards over the fulcrum pad 14 of the adjustable backrest 12. They can do this with her arms crossed across their chest or a broom handle or umbrella in their hands to take their arms up and back to enhance the thoracic range of motion.

In addition, an individual could use this device to assist in strengthening the thoracic spine. Placing a weight behind their neck or above their shoulders, sitting in the chair and bending backwards over the fulcrum lifting the weight up and back.

It should be understood, of course, that the foregoing relates to exemplary embodiments of the invention and that modifications may be made without departing from the spirit and scope of the invention as set forth in the following claims.

What is claimed is:

1. A therapeutic chair, comprising:
a frame supporting a seat, the frame having a front end and a back end, a left side and a right side, a guide extending inwardly from back end of the frame;
a vertically adjustable backrest having rail mounted to a left side and a right side of the backrest, the rail carried on the guide; and
a linear actuator having a first end and a second end, the first end coupled to the frame and the second end coupled to the backrest, the linear actuator operable to raise and lower the backrest relative to the seat along a plane defined by an alignment of the rail and the guide.

2. The therapeutic chair of claim 1 further comprising
a remote control operatively coupled to the linear actuator; and
one or more controls to selectively extend or retract the linear actuator.

3. The therapeutic chair of claim 1, further comprising:
a fulcrum pad attached to a top of the backrest and protruding into an occupant space of the therapeutic chair, wherein when the backrest is in a lowered position the fulcrum pad is positioned at a lumbar region of the occupant space.

4. The therapeutic chair of claim 3, wherein when the backrest is in an elevated position the fulcrum pad is positioned at a shoulder region of the occupant space.

5. The therapeutic chair of claim 4, further comprising:
a measuring device attached to the therapeutic chair configured to show an elevation of the backrest relative to the frame.

6. A therapeutic chair, comprising:
a frame supporting a seat, the frame having a front end and a back end, a left side and a right side;
a backrest;
a sliding guide and rail coupling interposed between the backrest and the frame to adjustably carry the backrest between a lowered position and an elevated position;
a fulcrum pad attached to a top of the backrest and protruding into an occupant space of the therapeutic chair, wherein when the backrest is in the lowered position the fulcrum pad is positioned at a lumbar region of the occupant space.

7. The therapeutic chair of claim 6 further comprising:
a linear actuator having a first end and a second end, the first end coupled to the frame and the second end coupled to the backrest, the linear actuator operable to raise and lower the backrest relative to the seat along a plane defined by an alignment of the sliding guide and rail coupling.

8. The therapeutic chair of claim 6, wherein when the backrest is in an elevated position the fulcrum pat is positioned at a shoulder region of the occupant space.

9. The therapeutic chair of claim 6, further comprising:

a measuring device attached to the therapeutic chair and configured to show an elevation of the backrest relative to the frame.

* * * * *